US010036973B1

(12) United States Patent
Sanmonji

(10) Patent No.: US 10,036,973 B1
(45) Date of Patent: Jul. 31, 2018

(54) IMAGE FORMING APPARATUS AND CLEANING METHOD

(71) Applicants: KABUSHIKI KAISHA TOSHIBA, Tokyo (JP); TOSHIBA TEC KABUSHIKI KAISHA, Tokyo (JP)

(72) Inventor: Yoshinori Sanmonji, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/415,474

(22) Filed: Jan. 25, 2017

(51) Int. Cl.
*G03G 15/02* (2006.01)

(52) U.S. Cl.
CPC ..... *G03G 15/0258* (2013.01)

(58) Field of Classification Search
CPC ..... G03G 15/0225; G03G 15/0258
See application file for complete search history.

(56) References Cited

U.S. PATENT DOCUMENTS

| | | | | |
|---|---|---|---|---|
| 5,455,661 | A | 10/1995 | Yoshida et al. | |
| 8,699,909 | B2 * | 4/2014 | Shibuya | G03G 15/0225 399/100 |
| 2001/0026694 | A1 * | 10/2001 | Sakaizawa | G03G 15/0225 399/50 |
| 2007/0003315 | A1 * | 1/2007 | Iwai | G03G 15/0258 399/100 |
| 2008/0187334 | A1 * | 8/2008 | Hano | G03G 15/0266 399/48 |
| 2008/0187361 | A1 * | 8/2008 | Sakagawa | G03G 15/0258 399/176 |

* cited by examiner

*Primary Examiner* — Sevan A Aydin
(74) *Attorney, Agent, or Firm* — Patterson & Sheridan, LLP

(57) ABSTRACT

An image forming apparatus according to an embodiment includes a photoconductive drum and a charging roller facing the photoconductive drum. The charging roller receives a potential bias. A controller performs an electrostatic cleaning operation by alternately applying, to the charging roller, a first bias and a second bias of opposite polarity to the first bias so that contaminants repelled by the first bias and contaminants repelled by the second bias are transferred from the charging roller to the photoconductive drum.

15 Claims, 7 Drawing Sheets

OPERATION OUTPUT EXAMPLE

| | CHARGING OUTPUT | | | DEVELOPING OUTPUT | TRANSFER OUTPUT |
|---|---|---|---|---|---|
| | DC | AC(Vpp) | FREQUENCY | | |
| AT THE TIME OF PRINT OPERATION | -600V | 1.5KV | 1KHz | -430V | +700V |
| AT THE TIME OF NON-PRINT OPERATION | -600V | 1.5KV | 1KHz | -430V | +100V |
| AT THE TIME OF CLEANING CONTROL OPERATION | +400V/-400V | 1.5KV | 1KHz | -20V | -200V |

FIG.8

IMAGE FORMING APPARATUS AND CLEANING METHOD

FIELD

Embodiments described herein relate generally to an image forming apparatus and a cleaning method.

BACKGROUND

In an image forming apparatus, a photoconductive drum is energized by a roller charging system so that a latent image can be formed thereon. The roller charging system includes a module for overlapping DC output and AC output in an output module. It is difficult to maintain charging equalization without changing the DC output over time. The overlapping of the AC output is excellent for equalizing the charge and also for suppressing an increase in resistance at the time of roller energization. However, through discharge of excessive current, the photoconductive drum is susceptible to damage, such as abrasion of a film on the surface of the photoconductive drum. Thus, a configuration is proposed in which an absolute value of the charging potential is reduced and current discharge is reduced at a time no image is being formed while the overlapping AC output is provided.

However, the deterioration of the photoconductive drum continues due to the discharging of the photoconductive drum, even if the discharging is weak. Further, in a case in which the discharging is not executed at a time no image is being formed, the photoconductive drum is rotated in a state in which the potential of the photoconductive drum is low. Thus, a repulsive force between remaining transfer toner on the photoconductive drum and the photoconductive drum is weak, and the remaining transfer toner is easy to remove through a cleaning blade. As a result, there is a problem that the charging roller may be contaminated. To prevent contamination, the surface may be cleaned by using a cleaning member (bristle brush or the like) against the charging roller. However, the arrangement of the cleaning member is a significant factor of cost increase.

DESCRIPTION OF THE DRAWINGS

FIG. 8 is a table with example output values at the time of a print operation, at the time of a non-print operation and at the time of a cleaning control operation.

DETAILED DESCRIPTION

An image forming apparatus according to an embodiment includes a photoconductive drum and a charging roller facing the photoconductive drum. The charging roller receives a potential bias. A controller performs an electrostatic cleaning operation by alternately applying, to the charging roller, a first bias and a second bias of opposite polarity to the first bias so that contaminants repelled by the first bias and contaminants repelled by the second bias are transferred from the charging roller to the photoconductive drum.

Figure 1:
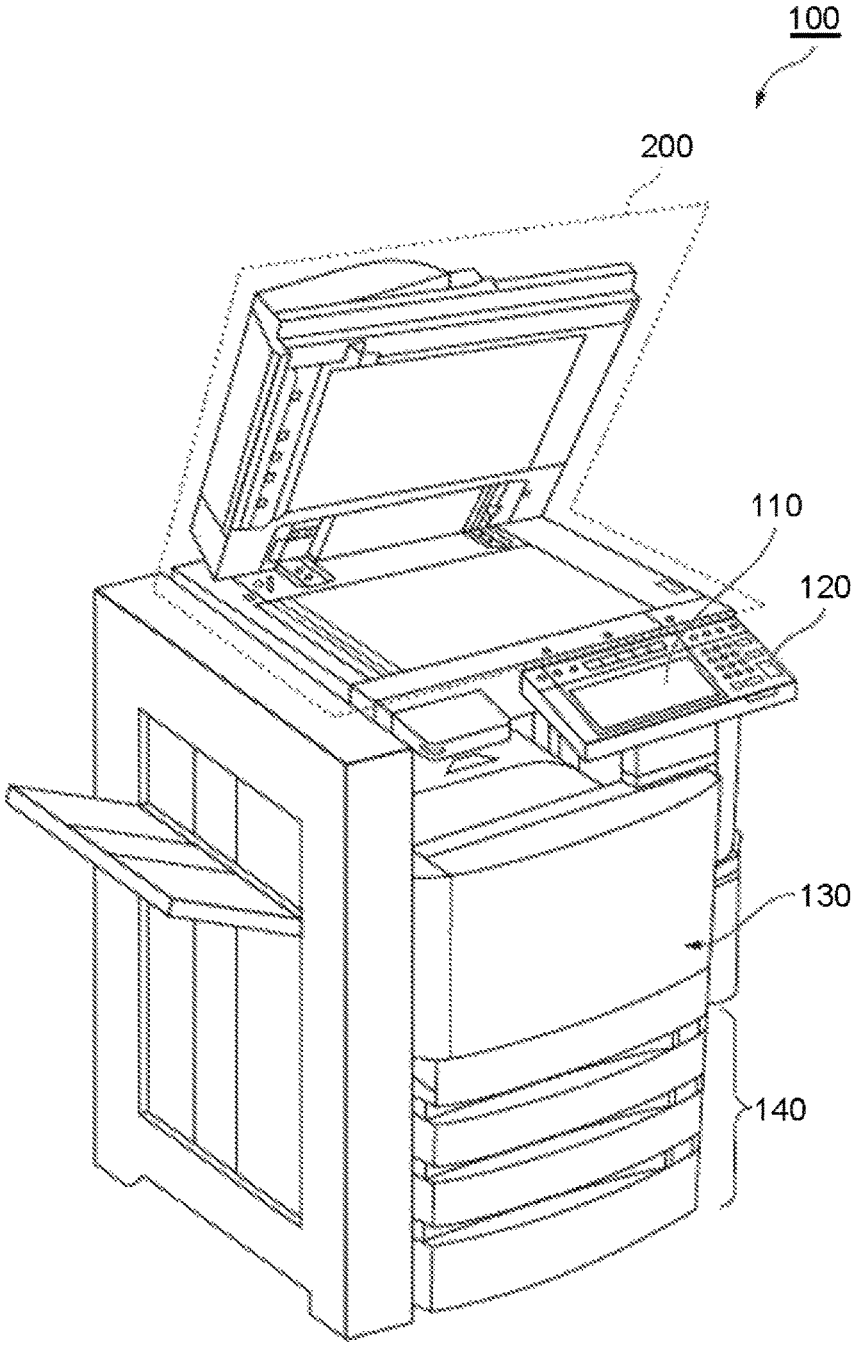
FIG. 1 is a perspective view illustrating an example configuration of an image forming apparatus according to an embodiment.

FIG. 1 is a perspective view illustrating an example configuration of an image forming apparatus 100 according to the embodiment. The image forming apparatus 100 is, for example, a multifunction peripheral. The image forming apparatus 100 includes a display 110, a control panel 120, a print unit 130, a sheet housing unit 140 and an image reading unit 200. Furthermore, the print unit 130 of the image forming apparatus 100 may be a device for fixing a toner image or an inkjet type device.

The image forming apparatus 100 forms an image on a sheet with a developing agent such as toner. The sheet is, for example, a paper or a label paper. The sheet may be any object as long as the image forming apparatus 100 can form an image on the surface thereof.

The display 110 is an image display device such as a liquid crystal display, an organic EL (Electro Luminescence) display or the like. The display 110 displays various kinds of information relating to the image forming apparatus 100.

The control panel 120 includes a plurality of buttons. The control panel 120 receives an input of an operation from a user. The control panel 120 outputs a signal in response to the operation input by the user to a controller of the image forming apparatus 100. Further, the display 110 and the control panel 120 may be integrally configured as a touch panel.

The print unit 130 forms an image on the sheet based on image information generated by the image reading unit 200 or image information received via a communication interface. The print unit 130 forms the image through, for example, the following processing. The print unit 130 at least includes an image forming unit and a fixing unit. The image forming unit includes a laser emitting unit 5, the photoconductive drum 10, a charging roller 20, a developing roller 30, a transfer roller 40 and a cleaning blade 50. The image forming unit of the print unit 130 forms an electrostatic latent image on a photoconductive drum 10 based on the image information. The image forming unit of the print unit 130 forms a visible image by attaching the developing agent to the electrostatic latent image. An example of the developing agent is toner. A transfer unit of the print unit 130 transfers the visible image onto the sheet. A fixing unit of the print unit 130 fixes the visible image on the sheet by applying heat and pressure to the sheet. Furthermore, the sheet on which the image is formed may be a sheet housed in a sheet housing unit 140 or a manually fed sheet.

The sheet housing unit 140 houses the sheet used for the image formation in the print unit 130.

The image reading unit 200 generates the image information by reading a reading object as the intensity of light. The image reading unit 200 records the read image information. The recorded image information may be sent to another information processing apparatus via a network. The recorded image information may be used to form an image on the sheet by the print unit 130.

Figure 2:
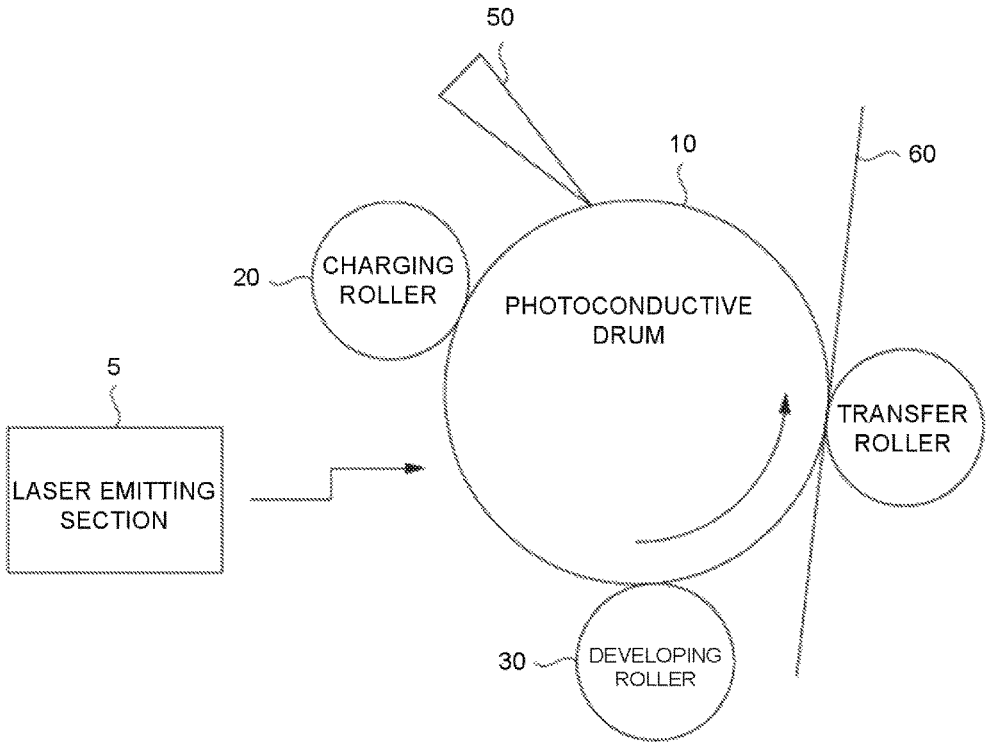
FIG. 2 is a cross-sectional view illustrating an example configuration of an image forming unit including a photoconductive drum.

The image forming unit, including the photoconductive drum 10 on which the electrostatic latent image is formed, is described with reference to FIG. 2. FIG. 2 is a cross-sectional view illustrating an example configuration of the image forming unit including the photoconductive drum 10.

The charging roller 20, the developing roller 30 and the transfer roller 40 are arranged adjacent to the photoconductive drum 10. The charging roller 20 charges the surface of the photoconductive drum 10. The laser emitting unit 5 selectively emits laser light to the surface of the photoconductive drum 10. The laser light removes the charge on portions of the surface of the photoconductive drum 10, and an electrostatic latent image is formed on the photoconductive drum 10. with the toner. The developing roller 30 develops the electrostatic latent image on the photoconductive drum 10 with toner to form a visible toner image. The transfer roller 40 transfers the toner image onto a sheet 60.

The cleaning blade 50 (cleaning unit) scrapes excess material such as residual toner left on the surface of the photoconductive drum 10. The laser emitting unit 5 further is used to remove the electricity of the whole photoconductive drum 10 at the time of an electrostatic cleaning control by the charging roller 20. The electrostatic cleaning control is a processing for removing dust of the charging roller 20 to the photoconductive drum 10.

With reference to FIG. 2, an image forming operation for forming an image on the sheet by the image forming unit is described. First, after the image information of the image required to be formed is received, the charging roller 20 charges the surface of the photoconductive drum 10. The laser emitting unit 5 emits the laser light to a part where an image is required to be formed on the photoconductive drum 10 on the basis of the image information to remove the electricity thereof. Then, the developing roller 30 forms the electrostatic latent image on the photoconductive drum 10 and forms a visible image by applying the developing agent to the electrostatic latent image. The transfer roller 40 transfers the visible image formed on the photoconductive drum 10 onto the sheet 60. The residual toner left on the photoconductive drum 10—that is, the toner that was not transferred to the sheet 60 by the transfer roller 40—is scraped by the cleaning blade 50.

Figure 3:
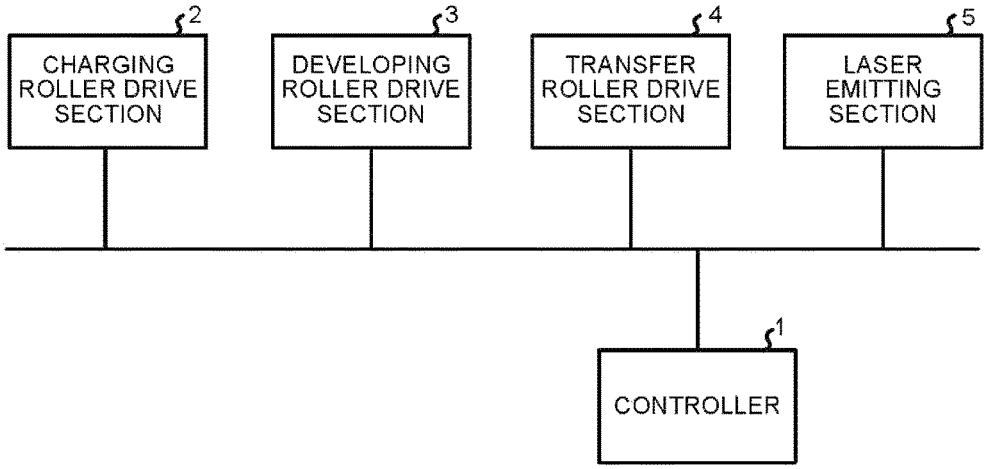
FIG. 3 is an example functional block configuration for controlling the image forming unit.

With reference to FIG. 3, the control of the components of the image forming unit shown in FIG. 2 are described. FIG. 3 is an example functional block configuration for controlling the image forming unit shown in FIG. 2. A control system includes a controller 1, a charging roller drive unit 2, a developing roller drive unit 3, a transfer roller drive unit 4, and the laser emitting unit 5.

In one embodiment, the controller 1 is a processor that is programmed to carry out the functions of the charging roller drive unit 2, the developing roller drive unit 3, the transfer roller drive unit 4, and the laser emitting unit 5. In another embodiment, the controller 11 is a hardware controller, e.g., an application specific integrated circuit (ASIC) and field programmable gate array (FPGA), that is configured to carry out the functions of the charging roller drive unit 2, the developing roller drive unit 3, the transfer roller drive unit 4, and the laser emitting unit 5.

The controller 1 collectively controls operations for executing the cleaning control of the charging roller 20 which charges the surface of the photoconductive drum 10. The charging roller drive unit 2 drives the charging roller 20 according to an operation instruction of the controller 1. The developing roller drive unit 3 drives the developing roller 30 according to an operation instruction of the controller 1. The transfer roller drive unit 4 drives the transfer roller 40 according to an operation instruction of the controller 1. The laser emitting unit 5 removes the electricity on the surface of the photoconductive drum 10 according to an instruction from the controller 1.

In the present embodiment, the cleaning control carried out by the controller 1 to clean the charging roller 20 is described. The cleaning control is carried out until particles (e.g., carrier particles and toner particles) on the charging roller 20 are collected by the cleaning blade 50.

Figure 4:
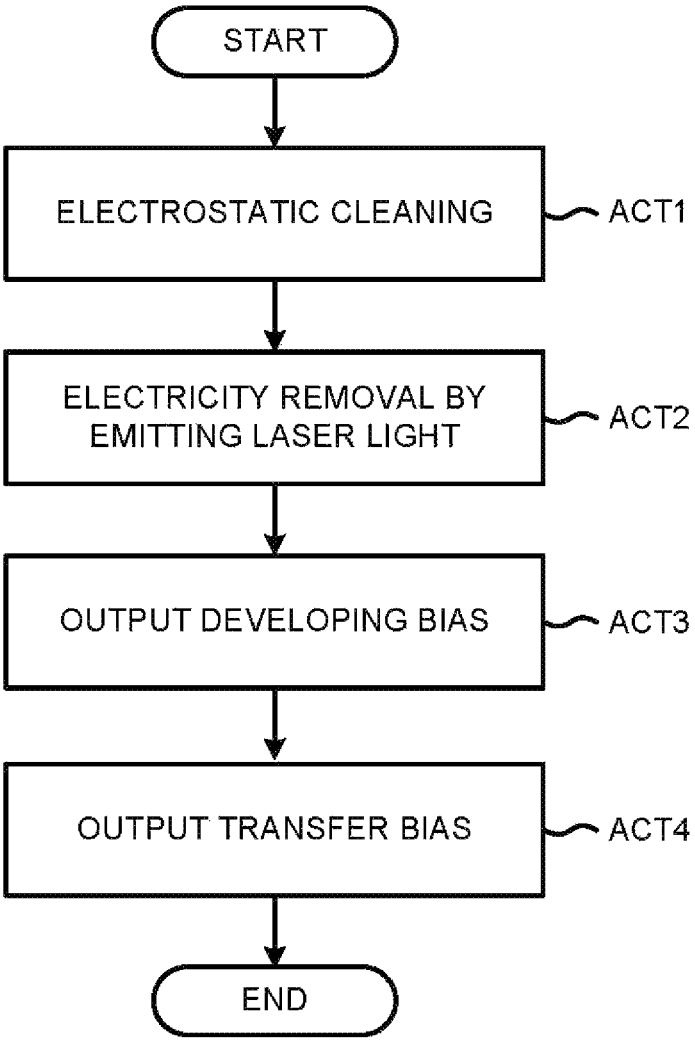
FIG. 4 is a flowchart illustrating an example sequence of operations of a cleaning control.

FIG. 4 is a flowchart illustrating an example sequence of operations of the cleaning control. First, the controller 1 controls an operation of the charging roller drive unit 2 to execute the electrostatic cleaning control (ACT 1). The charging roller drive unit 2 carries out the electrostatic cleaning control by alternating between ON and OFF of the charging everyone round of the charging roller 20 (for example, φ12). The charging roller drive unit 2 applies positive potential to the charging roller 20 at the ON time during the alternating output. When the charging roller drive unit 2 applies the positive potential of the positive polarity to the charging roller 20, bias output of positive potential from the charging roller 20 is executed. When the bias output of the positive potential from the charging roller 20 is carried out, the carrier (iron powder) adhering to the charging roller 20 is repulsed to move to the photoconductive drum 10.

On the other hand, the charging roller drive unit 2 applies the negative potential to the charging roller 20 at the OFF time during the alternating output. When the charging roller drive unit 2 applies the negative potential to the charging roller 20, bias output of the negative potential from the charging roller 20 is executed. When the bias output of the negative potential from the charging roller 20 is carried out, the toner adhering to the charging roller 20 is repulsed to move to the photoconductive drum 10.

In this manner, by executing the electrostatic cleaning control, the potential of the bias output from the charging roller 20 is alternately switched between positive negative. Thus, contaminants (carrier, unnecessary toner) attached to the surface of the charging roller 20 move to the photoconductive drum 10. The contaminants moved to the photoconductive drum 10 are then removed by being scraped by the cleaning blade 50.

The controller 1 controls the laser emitting unit 5 to remove the electricity of the whole surface of the photoconductive drum 10 during the cleaning control of the charging roller 20. The removal of the electricity by the laser emitting unit 5 continues while the alternating output to the charging roller 20 is performed.

In a case in which the alternating output to the charging roller 20 is carried out in a short time, there is a problem that carrier extraction may occurs or a toner band may adhere to the photoconductive drum 10. In such output control, as there is dispersion in rise/fall of the output, it is difficult to accurately execute the output control.

Thus, executing the cleaning control, the electricity on the surface of the photoconductive drum 10 is removed by the laser emitting unit 5 (LSU) arranged at the downstream side of a rotation direction of the charging roller 20. Thus, the potential of the whole surface of the photoconductive drum 10 becomes flat (ACT 2).

The controller 1 controls the operation of the developing roller drive unit 3 to output developing bias to the developing roller 30 arranged on the downstream side of the photoconductive drum 10 with respect to the laser emitting unit 5 in a rotation direction. It is necessary to control the developing bias output on the basis that the potential of the whole surface of the photoconductive drum 10 becomes flat through the electricity removal after the electrostatic cleaning control is carried out. In other words, it is necessary that the bias output of the developing roller 30 is set to a state in which there is no potential difference between the output of the developing roller 30 and the potential of the surface of the photoconductive drum 10. The developing roller drive unit 3 carries out the control in such a manner that the developing bias output of the developing roller 30 is equal to or smaller than −40V (−40V~0V). Thus, toner from the developing roller is prevented from adhering to the photoconductive drum 10 (ACT 3).

Through execution of the mentioned-above control by the controller 1, occurrence of the carrier extraction and the occurrence of the toner band can be avoided.

Next, the controller 1 controls the operation of the transfer roller drive unit 4 to output a transfer bias. If the potential of the photoconductive drum 10 is low, cleaning characteristics of the photoconductive drum 10 are worsened. Therefore, the transfer roller drive unit 4 carries out the control in such a manner that a transfer output at the time of the electrostatic cleaning control has the same polarity as the potential of the surface of the photoconductive drum 10 at the time of the image formation, and is equal to or smaller than the potential of the surface of the photoconductive drum 10. Thus, the contamination of the charging roller 20 adhering to the photoconductive drum 10 is not transferred to the transfer roller 40 (ACT 4). In this way, through controlling transferring bias output, it is possible to maintain the cleaning characteristics.

Furthermore, the controller 1 stores, in a storage unit, information indicating that the cleaning control is executed every two or more rotations of the charging roller 20 and two or more kinds of bias setting values. The controller 1 reads out the setting value at the time of the bias output by the charging roller 20 and executes the alternating output twice or more to carry out the cleaning control. Through executing the control, the cleaning can be effectively executed.

The cleaning control of the charging roller 20 described above can be executed before start of the image formation or after termination of the image formation. Before the start of the image formation refers to a period before the image forming operation described above is started. After the termination of the image formation refers to a period after the image forming operation described above is terminated.

The cleaning control may be executed at the time when no image is being formed, for example, between papers.

Furthermore, the processing in ACT 1-ACT 4 in FIG. 4 may be executed at the same time.

Figure 5:
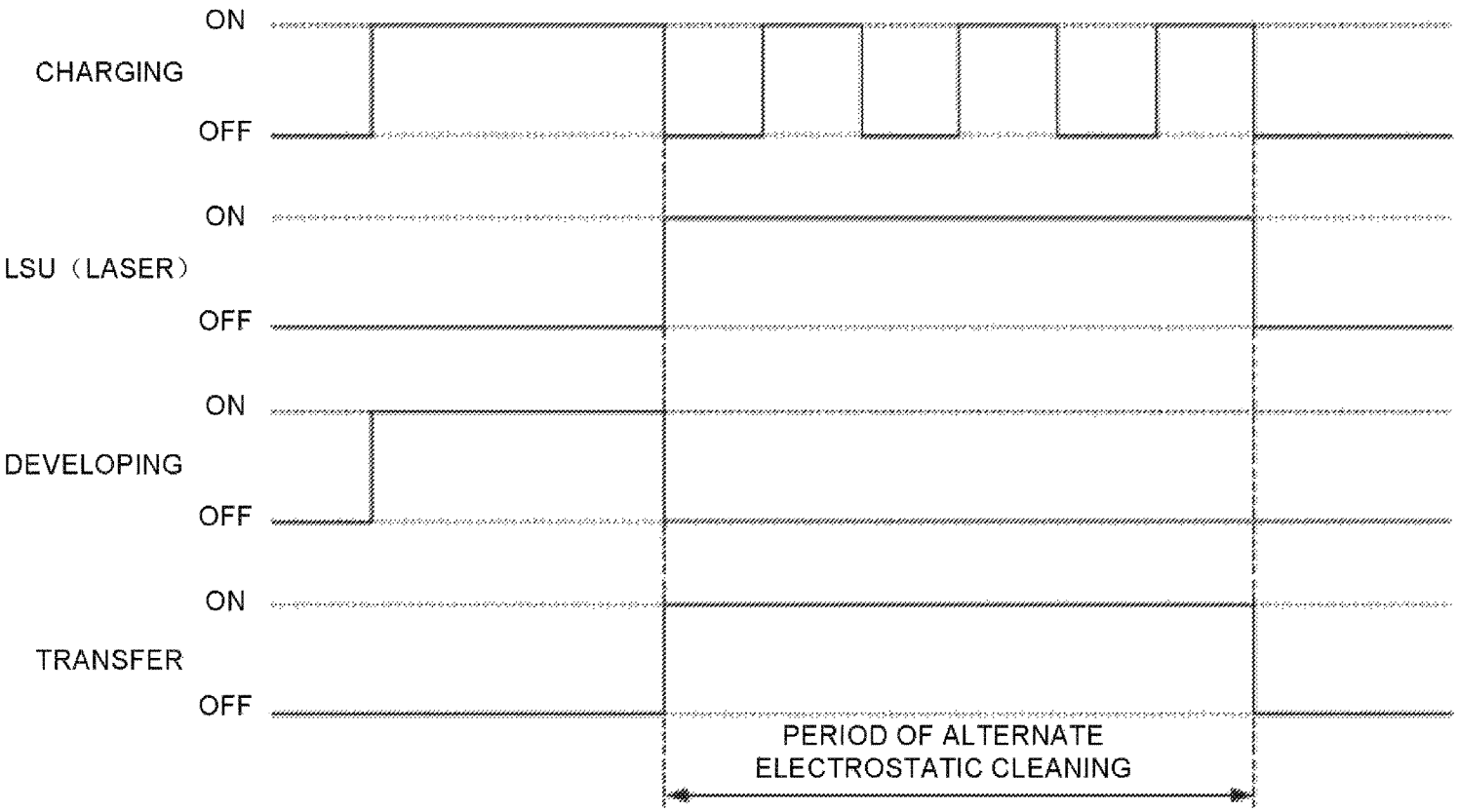
FIG. 5 is an example timing chart for a control operation.

With reference to a timing chart shown in FIG. 5, timing of the control operation mentioned above is described. FIG. 5 is an example timing chart for the control operation. The charging roller drive unit 2 repeats the ON/OFF charging during a period of an alternating electrostatic cleaning according to an instruction from the controller 1. The period of the alternating electrostatic cleaning refers to a period in which the electrostatic cleaning control is executed by alternately repeating the ON/OFF of the charging. Herein, at the OFF time, the negative potential is output, and at the ON time, the positive potential is output. The negative potential is, for example, −400 V. The positive potential is, for example, +400 V.

The laser emitting unit 5 irradiates the whole surface of the photoconductive drum 10 with the laser light during the period of the alternating electrostatic cleaning. In this way, the potential of the whole surface of the photoconductive drum 10 is removed.

Figure 6:
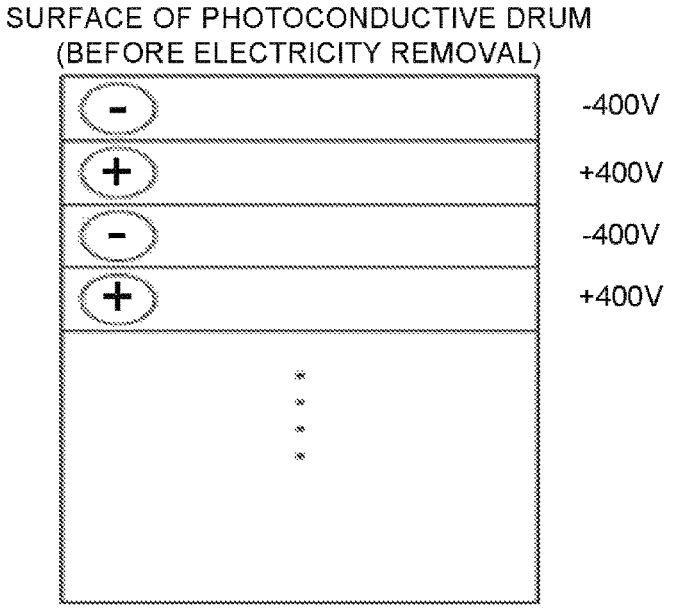
FIG. 6 illustrates an example state of the photoconductive drum after an electrostatic cleaning control is executed.

FIG. 6 illustrates a state of the photoconductive drum 10 after the electrostatic cleaning control is executed. FIG. 6 is a two-dimensional potential diagram of the surface of the photoconductive drum 10. The surface of the photoconductive drum 10 before the electricity removal is in a state in which an area which is charged with −400 V alternates with an area which is charged with +400 V.

Figure 7:
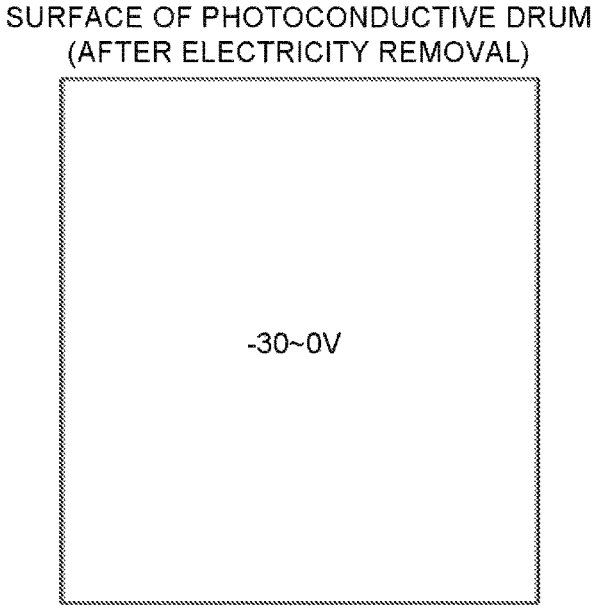
FIG. 7 illustrates an example state of the photoconductive drum after removal of electricity.

In this state, by emitting the laser light from the laser emitting unit 5, the electricity of the whole surface of the photoconductive drum 10 is removed. FIG. 7 illustrates an example state of the photoconductive drum 10 after the electricity removal. FIG. 7 is a two-dimensional potential diagram of the surface of the photoconductive drum 10. The surface of the photoconductive drum 10 after the electricity removal is in a uniform state of between −30 V and 0 V.

During the electrostatic cleaning, the developing roller drive unit 3 stops (OFF) the high potential developing bias output, −430 V for example, for applying toner according to an instruction of the controller 1. Instead, the developing roller drive unit 3 outputs the lower developing bias of between −20 V and 0 V. In this way, as there is no potential difference between the photoconductive drum 10 and the developing roller 30, the toner from the developing roller 30 does not adhere to the surface of the photoconductive drum 10.

The transfer roller drive unit 4 starts (ON) the transfer bias output during the electrostatic cleaning according to the instruction of the controller 1. In this way, the transfer bias output is, for example, −200 V. The transfer bias output is generally a positive value during image formation or when no image is being formed. However, by setting the transfer bias output to −200 V during the electrostatic cleaning, the toner on the photoconductive drum 10 is prevented from adhering to the transfer roller 40.

Furthermore, the same bias output by the charging roller 20 is continued at least until the charging roller 20 rotates once.

With reference to FIG. 8, the developing output and the transfer output are now described. FIG. 8 is a table with example output values at the time of the print operation, at the time of the non-print operation and at the time of the cleaning control operation. The charging output at the time of the print operation is an output with DC of −600 V, AC (Vp-p) of 1.5 kV, and a frequency of 1 kHz. The developing output and the transfer output at the time of the print operation are respectively −430 V and +700 V.

The charging output at the time when no image is formed is an output with DC of −600 V, AC (Vp-p) of 1.5 kV, and a frequency of 1 kHz. The developing output and the transfer output at the time when no image is formed are respectively −430 V and +100 V.

The charging output at the time of the cleaning control operation is an output with DC alternating between +400 V and −400 V at a frequency of 1 kHz, and standard AC (Vp-p) of 1.5 kV. The developing output and the transfer output at the time of the cleaning control operation are respectively −20 V and −200 V.

Furthermore, each output value shown in FIG. 8 is an example and the output values are not limited to those. Each output value is stored in the storage unit in the controller 1 in association with states of the image forming apparatus 100, and may be changed according to the state of the image forming apparatus 100. For example, each output value may be changed according to the number of sheets processed by the image forming apparatus 100.

Figure 9:
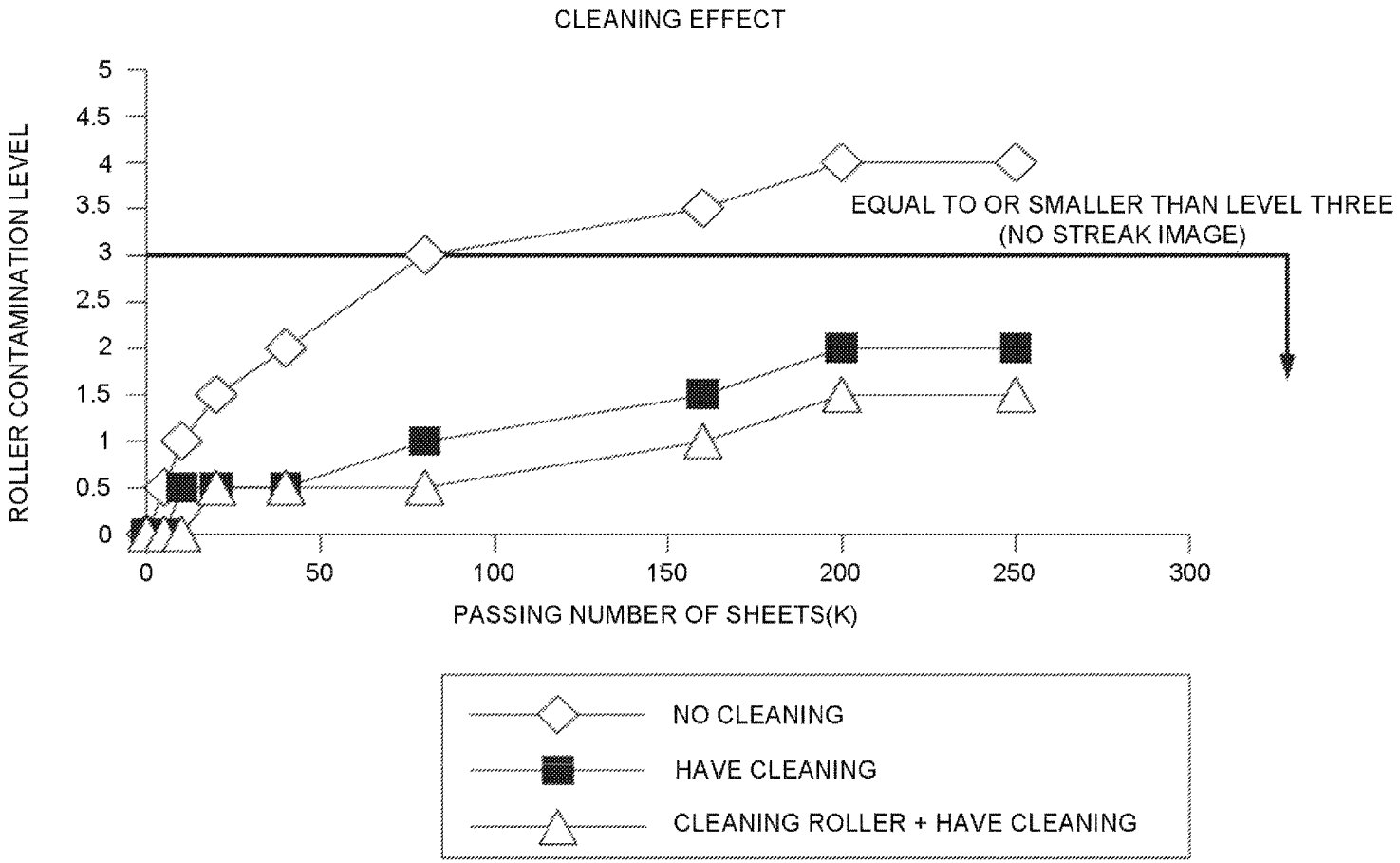
FIG. 9 illustrates an effect of the cleaning control.

The effect of the cleaning control is described. FIG. 9 is a view illustrating the effect of the cleaning control. In a case in which there is no cleaning control, white streak image caused by contamination of the charging roller 20 is generated after about 80K pieces of sheets. On the other hand, through applying the mentioned-above cleaning control, life-prolonging effect of three times or more can be obtained.

In this way, by applying the mentioned-above control, it is possible to suppress the contamination of the charging roller 20 without arranging expensive components such as a cleaning roller.

As stated above, the cleaning control of the embodiment applies the potential through the charging roller 20 which abuts against the photoconductive drum 10 and is opposite to the photoconductive drum 10. At the time of the image formation and at the time of that no image is formed, the output condition is changeable. In this way, an output control function for suppressing the abrasion of the film of the photoconductive drum 10 can be realized. The cleaning control is executed before the start of the image forming operation on the sheet by the image forming unit or after the termination of the image forming operation on the sheet. At the time of the cleaning control, the alternating bias output is executed twice or more so that at least two opposite biases are set. The electricity of the surface of the photoconductive drum 10 is removed through light emission by the laser emitting unit arranged at the downstream side of the rotation direction of the charging roller 20. The developing bias of the developing roller 30 positioned at the further downstream side is controlled at −40 V or smaller (between −40V and 0V). The transfer bias output of the downstream side of the developing roller 30 is set to be equal to or smaller than the potential of the surface at the time of image formation, and having the same polarity as the potential of the surface of the photoconductive drum 10.

Furthermore, it is described that the charging roller 20 contacts the photoconductive drum 10. However, the charging roller 20 may be away from the photoconductive drum 10 at a predetermined distance.

The cleaning control described above can suppress the abrasion of the film of the photoconductive drum 10 and the contamination of the surface of the charging roller 20 through the AC output.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a photoconductive drum;

a charging roller facing the photoconductive drum and configured to receive potential bias;

a light source facing the photoconductive drum downstream of the charging roller in a rotation direction, wherein the light source is configured to selectively apply laser light to the photoconductive drum to form a latent electrostatic image during image formation; and a controller configured to perform an electrostatic cleaning operation by:

alternately applying, to the charging roller, a first bias and a second bias of opposite polarity to the first bias, so that contaminants repelled by the first bias and contaminants repelled by the second bias are transferred from the charging roller to the photoconductive drum, and controlling the light source to apply light to the photoconductive drum to substantially remove potential bias on a surface of the photoconductive drum.

2. The image forming apparatus according to claim 1, wherein the electrostatic cleaning is performed when the image forming apparatus is not forming an image on a sheet.

3. The image forming apparatus according to claim 1, further comprising:

a developing roller facing the photoconductive drum downstream of the light source in the rotation direction and configured to apply toner to the latent electrostatic image to form a toner image during image formation, wherein the controller further performs the electrostatic cleaning operation by controlling a potential bias of the developing roller to have substantially the same potential bias as that of the surface of the photoconductive drum after the light source substantially removes the potential bias from the surface of the photoconductive drum.

4. The image forming apparatus according to claim 3, wherein the controller performs the electrostatic cleaning operation by controlling the potential bias of the developing roller to be between −40 V and 0 V.

5. The image forming apparatus according to claim 1, wherein the first bias is 400 V and the second bias is −400 V.

6. The image forming apparatus according to claim 5, wherein the first bias and the second bias are alternately applied at a frequency of 1 kHz.

7. A method of operating an image forming apparatus that includes a photoconductive drum and a charging roller facing the photoconductive drum and configured to receive potential bias, the method comprising the steps of:

alternately applying, to the charging roller, a first bias and a second bias of opposite polarity to the first bias;

while the first and second biases are alternately applied, rotating the charging roller so that contaminants repelled by the first bias and contaminants repelled by the second bias transfer from the charging roller to the photoconductive drum;

mechanically removing the transferred contaminants from the photoconductive drum;

with a light source facing the photoconductive drum downstream of the charging roller in a rotation direction, selectively applying laser light to the photoconductive drum to form a latent electrostatic image during image formation; and with the light source, applying light to the photoconductive drum to substantially remove potential bias on a surface of the photoconductive drum.

8. The method according to claim 7, wherein the electrostatic cleaning is performed when the image forming apparatus is not forming an image on a sheet.

9. The method according to claim 7, further comprising the step of:

controlling a potential bias on a developing roller, facing the photoconductive drum downstream of the light source in the rotating direction and configured to apply toner to the latent electrostatic image to form a toner image during image formation, to have substantially the same potential bias as that of the surface of the photoconductive drum after the light source substantially removes the potential bias from the surface of the photoconductive drum.

10. The method according to claim 9, wherein the potential bias of the developing roller is controlled to be between −40 V and 0 V.

11. The method according to claim 9, further comprising the step of:

controlling a potential bias on a transfer roller, facing the photoconductive drum downstream of the developing roller and configured to transfer the toner image to a sheet, to have the same polarity as the potential bias of the surface of the photoconductive drum and to be equal to or smaller than the potential bias of the surface of the photoconductive drum.

12. The method according to claim 7, wherein the first bias is 400 V and the second bias is −400 V.

13. The method according to claim 12, wherein the first bias and the second bias are alternately applied at a frequency of 1 kHz.

14. An image forming apparatus, comprising:

a photoconductive drum;

a charging roller facing the photoconductive drum and configured to receive potential bias to charge the photoconductive drum;

a light source facing the photoconductive drum downstream of the charging roller in a rotation direction and configured to selectively apply laser light to the photoconductive drum after the charging roller has applied a uniform potential bias to the photoconductive drum to form a latent electrostatic image during an image formation;

a developing roller facing the photoconductive drum downstream of the light source in the rotating direction and configured to apply toner to the latent electrostatic image to form a toner image during the image formation;

a transfer roller facing the photoconductive drum downstream of the developing roller and configured to transfer the toner image to a sheet during the image formation; and a controller configured to perform an electrostatic cleaning operation after the image formation by:

alternately applying, to the charging roller, a first bias and a second bias of opposite polarity to the first bias so that contaminants repelled by the first bias and contaminants repelled by the second bias are transferred from the charging roller to the photoconductive drum, controlling the light source to apply light to the photoconductive drum to substantially remove potential bias on a surface of the photoconductive drum so that the contaminants do not adhere to the photoconductive drum, controlling a potential bias of the developing roller to have substantially the same potential bias as that of the surface of the photoconductive drum so that toner from the developing roller does not transfer to the photoconductive drum, and controlling a potential bias of the transfer roller to have the same polarity as the potential bias of the surface of the photoconductive drum and to be equal to or smaller than the potential bias of the surface of the photoconductive drum so that the contaminants from the photoconductive drum do not transfer to the transfer roller.

15. The image forming apparatus according to claim 14, further comprising:

a cleaning device facing the photoconductive drum downstream of the transfer roller and configured to mechanically remove the contaminants transferred to the photoconductive drum during the electrostatic cleaning operation and to mechanically remove residual toner from the photoconductive drum during the image formation.

* * * * *